US005692098A

United States Patent [19]

Kurdziel

[11] Patent Number: 5,692,098

[45] Date of Patent: Nov. 25, 1997

[54] REAL-TIME MOZER PHASE RECODING USING A NEURAL-NETWORK FOR SPEECH COMPRESSION

[75] Inventor: Michael Thomas Kurdziel, Rochester, N.Y.

[73] Assignee: Harris, Melbourne, Fla.

[21] Appl. No.: 414,012

[22] Filed: Mar. 30, 1995

[51] Int. Cl.[6] ..... G10L 7/02

[52] U.S. Cl. ..... 395/2.11; 395/2.14; 395/2.67

[58] Field of Search ..... 395/2.1, 2.11, 395/2.12, 2.14, 2.15, 2.67, 2.76

[56] References Cited

U.S. PATENT DOCUMENTS

| | | | |
|---|---|---|---|
| 3,763,364 | 10/1973 | Deutsch et al. | 364/718 |
| 4,214,125 | 7/1980 | Mozer et al. | 395/277 |
| 4,384,169 | 5/1983 | Mozer et al. | 395/22.15 |
| 4,433,434 | 2/1984 | Mozer | 395/2.2 |
| 4,435,831 | 3/1984 | Mozer | 395/2.76 |
| 4,683,793 | 8/1987 | Deutsch | 84/607 |
| 4,702,142 | 10/1987 | Deutsch | 84/605 |
| 5,148,385 | 9/1992 | Frazier | 364/728.07 |
| 5,202,953 | 4/1993 | Taguchi | 395/2.09 |
| 5,220,640 | 6/1993 | Frank | 395/2.11 |
| 5,255,342 | 10/1993 | Nitta | 395/2.09 |
| 5,285,522 | 2/1994 | Mueller | 395/2.41 |

OTHER PUBLICATIONS

Kurt Hornik, Maxwell Stinchcombe, and Halbert White, "Multilayer Feedforward Networks are Universal Approximators", Neural Networks, vol. 2, No. 5, pp. 359–366.

Narayan, Sridhar, *ExpoNet: A Generalization of the Multi--Layer Perception Model*, Department of Computer Science, Clemson University, pp. III–494 to III–497, Proceedings of the International Joint Conference on Neural Networks, 1993.

*Static, Dynamic Strategies for Coding the Speech Waveform*, "Mozer Coding", Chapter 2, Section 2.6, pp. 48–51, in Panos E. Papamichalis *Practical Approaches to Speech Coding*, Prentice–Hall, 1957.

*Primary Examiner*—Allen R. MacDonald
*Assistant Examiner*—Tālivaldis Ivars Šmits
*Attorney, Agent, or Firm*—Rogers & Killeen

[57] ABSTRACT

A system and method for compressing speech using an artificial neural network to calculate the recoded phase vector (Mozer code) resulting from the spectral magnitude-to-phase transformation. Raw speech is equalized to remove the spectral tilt and segmented into analysis frames. The spectral magnitudes of each frame segment are determined at a plurality of points by a Fourier Transform, normalized, and applied to a neural net magnitude-to-phase transform calculator to provide a recoded phase vector. An Inverse Discrete Fourier Transform is used to calculate the new recoded speech waveform in which the two quarters with minimum power are zeroed to produce the compressed speech output signal.

16 Claims, 4 Drawing Sheets

REAL-TIME MOZER PHASE RECODING USING A NEURAL-NETWORK FOR SPEECH COMPRESSION

BACKGROUND OF THE INVENTION

The present invention is related to the phase recoding of speech segments for speech compression in the time domain.

The insensitivity of human hearing to short-time phase is well known. As a result, speech segments may be recoded by the manipulation of phase parameters into a compressed waveform which does not resemble the original waveform but which retains the same sound to the human ear.

As shown in the U.S. Pat. No. 4,214,125 to Mozer, et al. dated Jul. 22, 1980, and described in Papamichalis, Panos E., *Practical Approaches to Speech Coding,* Englewood Cliffs, N.J.: Prentice Hall, Inc. 1987, Ch. 2, pp. 48–51, it is known to segment a speech waveform, obtain a Fourier transform of the segment (a plot of signal amplitude versus frequency aka a "power spectrum"), adjust the phase of the Fourier transform to either 0° or 180° while preserving the coefficient amplitudes. Because the resulting waveform is symmetric about the center of the frame, only one-half of the waveform needs to be stored/transmitted. Further, the low power segments which are discarded may be replaced later with a constant in the reproduction of the speech sound. In this way a 4:1 compression ratio may be obtained.

A major disadvantage of such known systems is the length of processing time required to search all possible waveform phase combinations. Because the processing time is excessive, the utility of such systems is limited to speech response systems. In classic Mozer Coding, the recoding of a 128 bit sample, 16 bits per sample, requires 42 hours on a Sparc 2 workstation if all combinations are searched.

Some texts refer to "proprietary techniques" for speeding up the search. Such techniques are in the form of a heuristic employed in the search strategy to reduce the subsets of combinations which must be searched to achieve an approximation. With the use of a heuristic, applicant has been able to reduce the time from 42 to 12 hours, but at a cost of 10% to 20% distortion.

It is accordingly an object of the present invention to provide a novel system and method of Mozer Coding which reduces the distortion of the final waveform relative to the heuristically driven Mozer Coder using neural networks trained with optimal pattern sets.

It is another object of the present invention to provide a novel system and method of phase recoding which is suitable for real-time applications.

It is another object of the present invention to provide a novel system and method of phase recoding which can be recorded with less perceived distortion.

Other phase recoding techniques are known. However, such techniques are not intended to compress the waveform for storage/transmission.

In one aspect of the present invention, a Fourier transform is used to convert each segment of speech into a spectral magnitudes or a power spectrum, and a neural net is used to transform these magnitudes into phase vectors and to calculate a phase vector for the recoded segment. Neural nets are known. For example, the Frazier U.S. Pat. No. 5,148,385 dated Sep. 15, 1992 discloses a system capable of performing neural calculations.

It is accordingly an object of the present invention to provide a novel system and method in which neural nets are used to transform spectral magnitudes into phase vectors for real-time Mozer Coding.

It is another object of the present invention to provide a novel system and method in which neural nets are used to calculate the phase vectors for recoded speech segments.

There are systems such as Linear Predictive Coding which require pitch detection rather than assuming it to be a constant.

It is accordingly an object of the present invention to provide a novel system and method in which pitch is detected for use by the neural net.

While it may have been recognized that the recoded phase vector of compressed speech is a function of the spectral magnitudes of a segment for each compression format, no algebraic expression is known to the applicant.

It is accordingly an object of the present invention to provide a novel system and method which approximates the recoded phase vector as a function of the spectral magnitude of a segment for each compression format.

Because the relationship between spectral magnitudes and the recoded phase vector is non-linear and complex, and because the complexity increases with the number of magnitude terms, the computational problem is difficult. Complexity may, of course, be reduced by restricting the range of the magnitudes and the number of discrete levels to which the magnitudes are quantized, but only at the expense of distortion in the reproduction of the sound.

It is accordingly an object of the present invention to provide a novel system and method in which a neural net is used in the calculation of the transforms.

It is a further object of the present invention to provide a novel system and method in which use of a neural net will allow the calculation to be performed in real-time.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
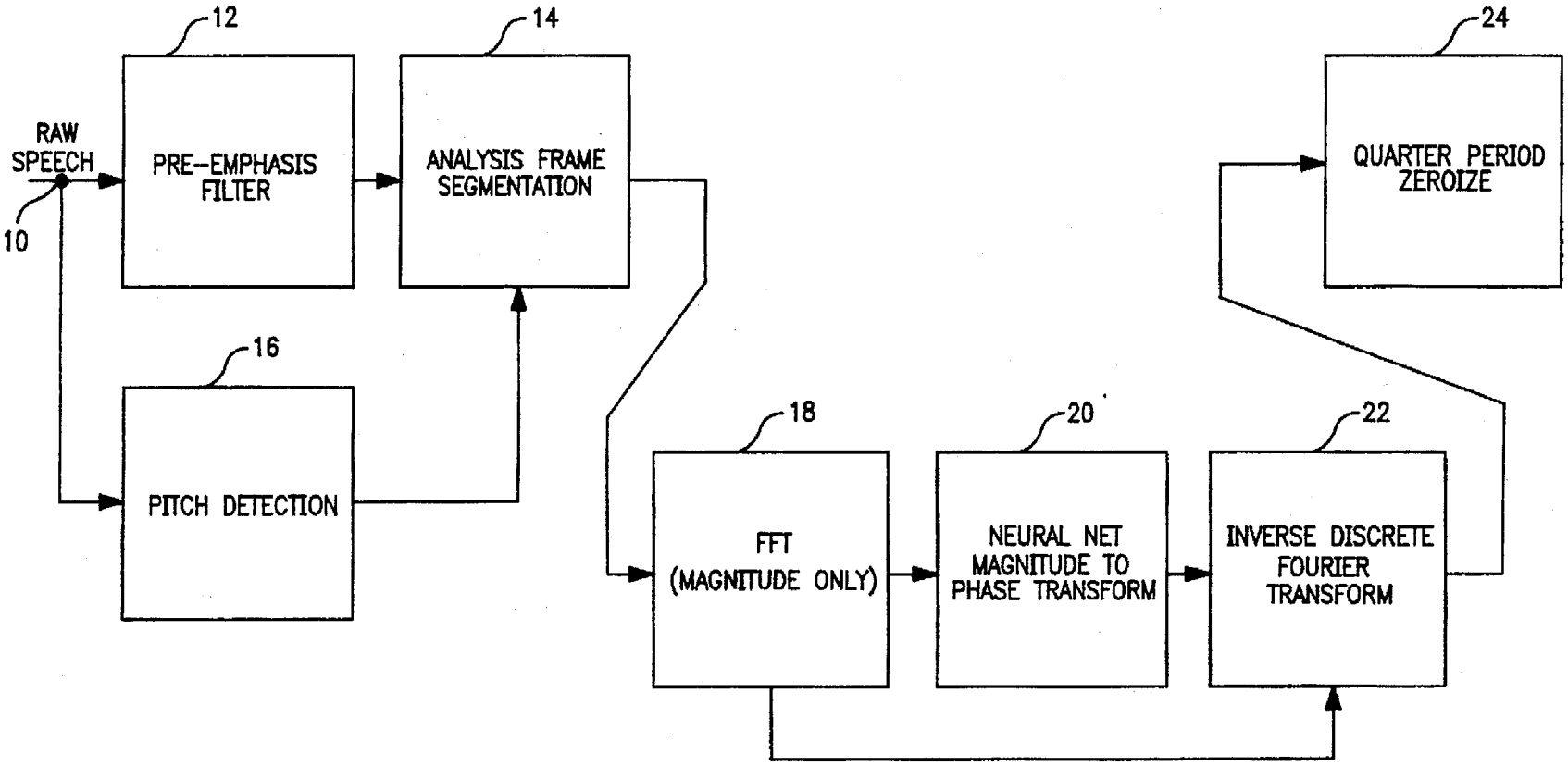
FIG. 1 is a functional block diagram of one embodiment of a neural net based speech recoding system of the present invention.

With reference to FIG. 1, the technique of the present invention is illustrated. The technique is generic to several operative neural net based speech recoding systems using different neural network architectures.

In FIG. 1, raw speech is applied to an input terminal 10 of a suitable conventional pre-emphasis FIR high pass filter 12 where the spectral magnitudes of the speech waveform are equalized. The filter may be considered a "leaky" differentiator. For example, unvoiced speech has roughly equal spectral components across the 0–4 KHz band of interest, but voiced speech has predominantly higher spectral magnitudes at frequencies below about 1 KHz than at frequencies 1–4 KHz. The effect of pre-emphasis in the filter 12 is to equalize or flatten the spectrum for voiced speech.

Flattening the spectrum is desirable because without it a higher resolution (i.e., more bits) would be required to adequately quantize the high frequency components.

In addition, this technique combines the sine waves of each component coherently in the second and third quarters but not in the first and fourth quarters thereof. Because of the character of an unfiltered voice segment, the amplitudes of the higher frequency components would be too small to provide meaningful cancellation of the lower frequency components in the first and fourth quarters in the absence of such flattening.

The important aspect of the pre-emphasis filter is that its effects can be predictably reversed during de-emphasis in the decoding stage. The use of a single zero digital FIR filter permits the calculation of the inverse and implemented as a single pole IIR filter. As set out in Papamichalis, Panos E., *Practical Approaches to Speech Coding,* Englewood Cliffs, N.J.: Prentice hall, Inc. 1987, the following relations apply:

pre-emphasis:

$$y[k]=x[k]-Ax[k-1] \quad (1)$$

de-emphasis:

$$z[k]=y[k]+Az[k-1] \quad (2)$$

where A is a constant generally chosen $0.90<A<1.00$;

y[k] is the pre-emphasized speech;

x[k] is unprocessed speech; and z[k] is the de-emphasized speech.

In lieu of the filter 12, a conventional 1 KMz high pass, RC filter may be used before the raw speech is digitized.

With continued reference to FIG. 1, the pre-emphasized and filtered speech from the filter 12 is applied to a segmentation circuit 14 where the speech is segmented into initial analysis frames, i.e., the number of samples in each speech segment. The number of samples is important because distortion is introduced at the analysis frame frequency. If the speech is not properly segmented, the pitch of the recoded speech will sound perceptibly different. This is a subjective problem and the ratio of segment width to the pitch period of raw speech may be varied for different applications.

If the segments are one pitch period wide, the speech may be additionally compressed by preserving one detected pitch period for N segments. Because the pitch period of speech changes slowly, acceptable quality speech can often be produced with an additional N:1 compression.

The manner in which pitch is determined, and the manner in which it is used to segment the speech, may vary depending on the implementation. It is desirable that the implementation, with the exception of the neural network, be in software as an algorithm.

The circuit 14 may be any suitable conventional circuity for accomplishing the functions described above.

The raw speech applied to the terminal 10 in FIG. 1 is also applied to a suitable conventional pitch detector 16 where the pitch of the raw speech is detected and applied to the frame segmentation circuit 14 for association with the analysis of each frame segment. The pitch detector will improve recoded speech quality if detected as an average value. However, further improvement can be obtained by continuously detecting the pitch and associating it with the segments.

As is well known, there are 34 sounds or phonems in the General American Dialect, exclusive of diphthongs, affricates and minor varients, and these phonems may be voiced (i.e., excited by the vocal chords) or unvoiced. The voiced phonemes are quasi-periodic, and the period thereof is known as the "pitch period" or "pitch" of the phonemes.

The addition of pitch information increases the complexity of the algorithm, but results in a more naturally sounding speech. Where speed is critical, it may be achieved by the elimination of the pitch detection and utilization of a constant segment length in performing its calculations.

The output signal from the circuit 14 is applied to a Discrete Fourier Transform or FFT 18 where spectral magnitudes are determined at each of 64 points. The FFT may be any suitable conventional circuit capable of performing a Discrete Fourier Transform.

The output signal from the FFT 18 is normalized and is applied to a neural net magnitude to phase transform calculator 20 where a recoded phase vector is calculated.

Figure 2:
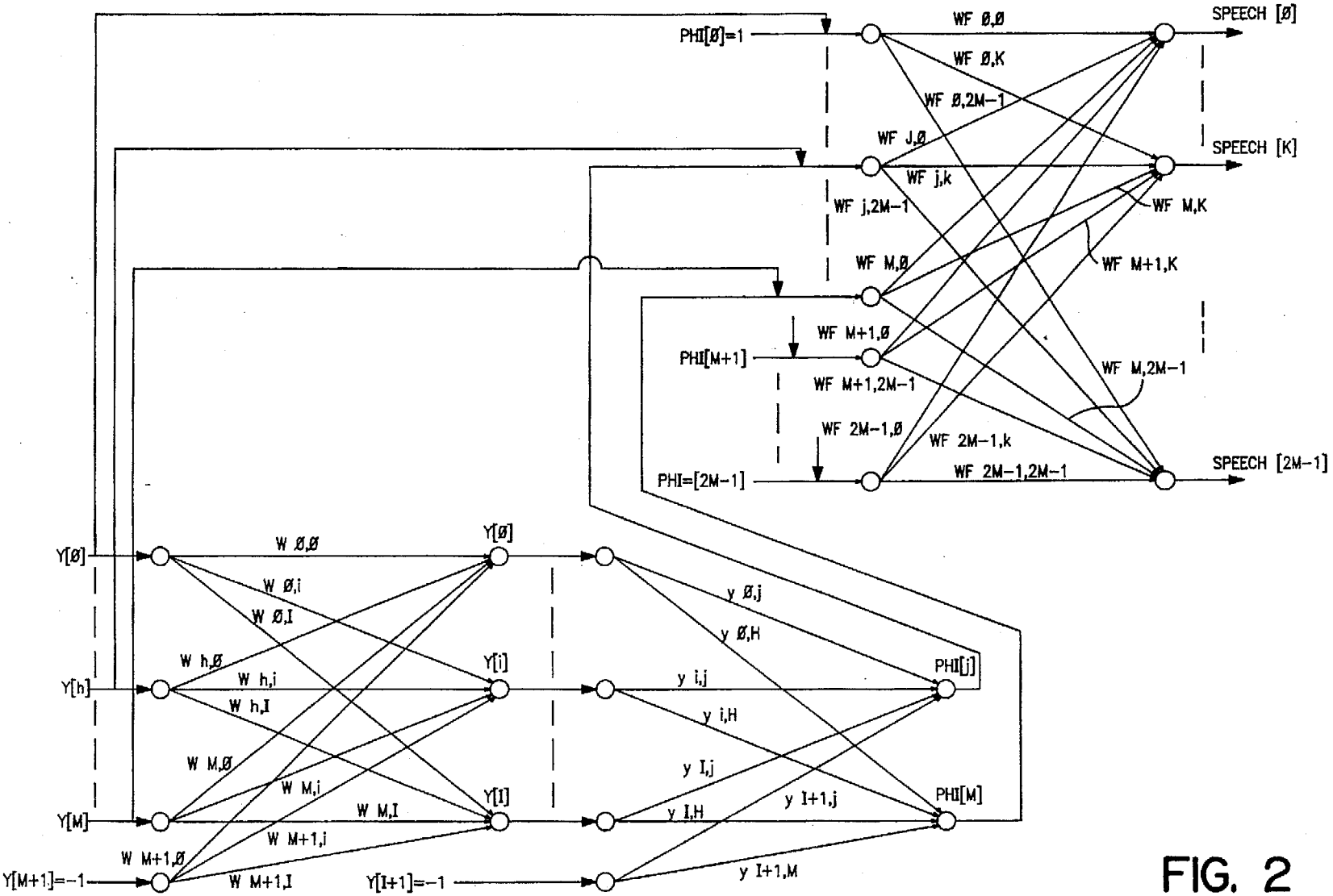
FIG. 2 is a schematic diagram of one embodiment of a four layer neural network usable in the neural net magnitude to phase transform of FIG. 1.

One embodiment of the neural net calculator 20 is illustrated in FIG. 2 and described in detail below.

The output of the neural net calculator 20 is applied to an Inverse Discrete Fourier Transform circuit 22, together with the original un-normalized spectral magnitudes also determined in the FFT 18, where a new recoded speech waveform is calculated. The circuit 22 may be any suitable conventional circuit capable of performing a Discrete inverse Fourier transform. Alternatively, the circuit 22 may be implemented in commercially available software which is well suited to the real-time requirements of this technique.

The output signal from the Fourier transform circuit 22 is applied to a quarter period zeroize circuit 24 where those quarters with minimum power are zeroed to produce the compressed speech output signal at the output terminal 26. Only one of the second and third quarters will have to be stored/transmitted to characterize the entire frame. Additional conventional waveform coding techniques may be used to further compress the quarter frame, e.g., differential pulse code modulation.

In operation, the raw speech is filtered to equalize the spectral amplitudes, i.e., remove any spectral tilt, and analyzed to determine the pitch thereof. If the speech is unvoiced and thus has no associated pitch period, a constant (e.g., 16 ms) is assumed.

The filtered speech is segmented into frames. The length of the frames is proportional to the pitch period. The segments are then processed by the FFT to determine the spectral magnitudes.

The magnitude to phase transform is calculated and used to produce the recoded phase vector. This phase vector, together with the original spectral magnitudes, is processed with an inverse Discrete Fourier Transform to provide a recoded symmetric waveform of the form shown in FIG. 3B. Finally, the first and fourth quarter waveforms are zeroed to produce a waveform in the form shown in FIG. 3C. Only one of the second and fourth quarters is needed to characterize the entire frame resulting in a 4:1 compression ratio. Additional compression is available through the use of conventional techniques.

One embodiment of a neural phase recoder is illustrated in FIG. 2. This embodiment is based on a generalization of the Perceptron model known as the ExpoNet described in Sridhar Narayan, "ExpoNet: A Generalization Of The Multi-Layer Perceptron Model", *Proceedings of the IJCNN,* Vol III, 1993, pp. 494–497. However, the system and method of the present invention may be implemented with neural nets based on other known models, e.g., Multi-Layer Perceptron.

With reference to FIG. 2, the neural network typically consists of three layers, i.e., an input layer, a hidden layer, and an output or phase calculation layer. A fourth layer, here referred to as the Inverse Discrete Fourier Transform or IDFT layer, is not part of the typical neural net structure. The IDTF is therefore shown as a separate circuit 22 in FIG. 1 but included in FIG. 2 for illustrative purposes.

The network of FIG. 2 is a feed forward network operational as described by the following equations where the analysis frame is 2M samples and M is an integer:

$$Y[i]=f_1\left(\sum_{h=0}^{M+1} Whi\times(F[h])^{Wexphi}\right) \text{ for } i=0,\ldots,I \tag{3}$$

where Y[i] is the hidden layer output;

f1( ) is the unipolar sgn nonlinearity function;

Whi, Wexphi are trainable weight vectors; and

F[h] is the Fourier magnitude vector.

$$PHI[j]=f_2\left(\sum_{i=0}^{I+1} Vij\times(Y[j])^{Vexpji}\right) \text{ for } j=0,\ldots M \tag{4}$$
$$PHI[2M-j]=-PHI[j]$$

where PHI[j] is the phase vector;

f2( ) is the bipolar nonlinearity function; and

Vij, Vexpji are trainable weight vectors.

Note: The bipolar continuous function is used for f2( ) during training.

$$\text{speech}[k]=\left(\sum_{j=0}^{2M-1}(PHI[j]\times F[j]\times WFjk)\right) \text{ for } f=0,\ldots,2M-1 \tag{5}$$

$$\text{where: } WFjk=\cos(2\pi kj/2M+\pi j/2M)$$

The network is trained in the batch mode using the Error Backpropagation Training Algorithm shown in J. Zurada, *Introduction To Artificial Neural Systems,* St. Paul, Minn., West Publishing Co., 1992, pp. 185–190.

The following calculations may be used for error calculation and weight modification.

$$\Delta PHI[j]=\tfrac{1}{2}\{TRAINPHI[j]-PHI[j]\}\times\{1-(PHI[j])^2\} \text{ for } j=1,\ldots,M$$
$$\text{where: } TRAINPHI[j] \text{ is the Training Phase Vector} \tag{6}$$

$$Vij=Vij+(\eta\times\Delta PHI[j]\times Y[i]) \tag{7}$$

$$Vexpij=Vexpij+\{\alpha Vij\times ln(Y[i])\times(Y[i])^{Vexpij}\times\Delta PHI[j]\} \text{ for } i=0,\ldots I+1\ j=1,\ldots,M \tag{8}$$

where: $\alpha$ is the exponent learning constant $\eta$ is also a learning constant $$Y[i]=f1'\left(\sum_{N=0}^{2M} Whi\times(F[h])^{Wexphi}\right)\times\left(\sum_{J=1}^{M}\Delta PHI[j]\times Vji\right) \tag{9}$$
$$\text{for } i=0,\ldots,I$$

where: f1'( ) is the derivative of the f1 nonlinearity $$Whi=Whi+(\eta\times\Delta Y[i]\times F[h]) \tag{10}$$

$$Wexphi=Wexphi+\{\alpha Whi\times ln(F[h])\times(F[h])^{Wexphi}\times\Delta Y[i]\} \text{ for } i=0,\ldots,I\ h=0,\ldots,2m \tag{11}$$

Other suitable conventional training algorithms may be used. While Error Back Propagation Training Algorithm is the only one specified for use with the ExpoNet, other algorithms may be used with other structures, e.g., Generalized Delta Rule and Error Back Propagation with Momentum may be used.

The operation of neural nets is well known and a general description thereof is available in Zurada, Jacek; *Introduction to Artificial Neural Systems,* St. Paul, Minn., West Publishing Co., 1992. In the training mode, a set of "training patterns" is applied to the network. These patterns are examples of spectral magnitudes and their corresponding recoding phase patterns. The internal weights are modified such that the network will eventually be able to produce an approximation to the recoded phase pattern given the corresponding spectral magnitude pattern. (See equations (3)–(11) above).

The size of the training set depends on experimental results, but must be sufficiently large so that the trained network can effectively generalize to the set of all possible spectral magnitude patterns expected to be applied in practice. A set of 1,000 patterns has been found to be sufficient.

In the present implementation, ExpoNet has been modified to use the bipolar continuous function for f2( ) during training. During normal operation, the bipolar threshold function is used for f2( ). This is appropriate because the network has been trained to include the bipolar threshold function's behavior and imposes a significantly reduced computational burden in practice. If replacing the bipolar continuous function with the bipolar threshold function does not affect the final performance of the network (and it does not in the embodiments disclosed herein), then the replacement should be accomplished.

The operation of the embodiment of the invention illustrated in FIG. 1 may be explained in connection with the waveforms of FIG. 3.

Figure 3A:
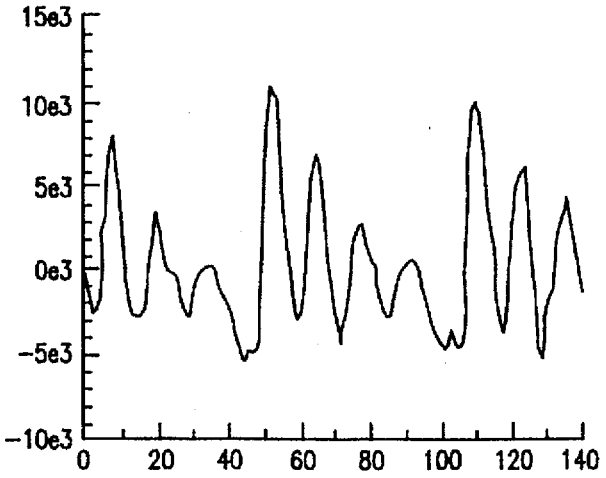
FIGS. 3A, 3B and 3C are speech waveforms illustrating respectively a segment of raw speech, the same segment pre-emphasized with a high pass filter and processed through the neural phase recoder, and the same segment in its final compressed form.
Figure 3B:
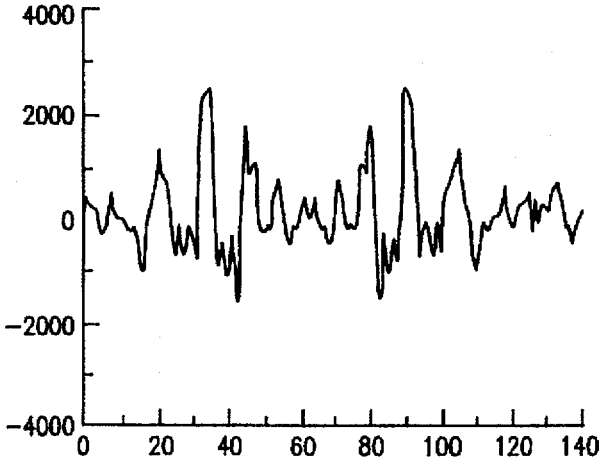

FIG. 3A illustrates a segment of raw speech such as may be applied to the input terminal 10 of FIG. 1. FIG. 3B shows the same segment after processing by the filter 12 and the neural phase recoder 20 of FIG. 1. The pre-emphasizing of the speech waveform in the filter 12 removes spectral tilt as discussed supra. The phase recoding technique reduces the energy in the segment in the first and fourth quadrants by destructively combining the spectral components, and thus performance is enhanced by pre-emphasis.

The recoded waveform may be deemphasized as part of the decoding procedure. With reference to FIG. 4, the uncompress operation circuit 30 will reproduce the original processed waveform of FIG. 3C from the quarter frame which was stored/transmitted. The first and fourth quarter may be left at zero or replaced with a constant amplitude signal chosen objectively to provide the desired speech quality.

Figure 3C:
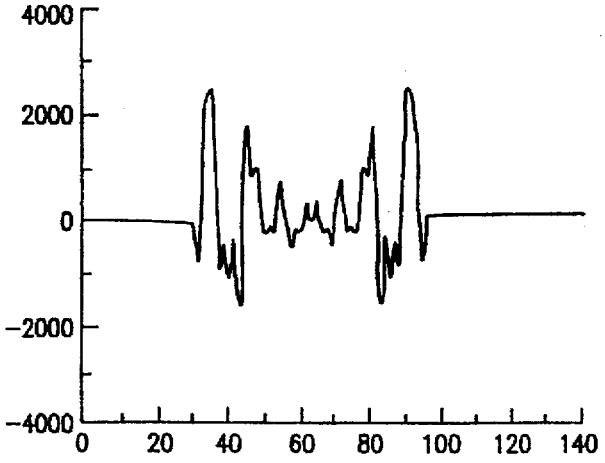
Figure 4:
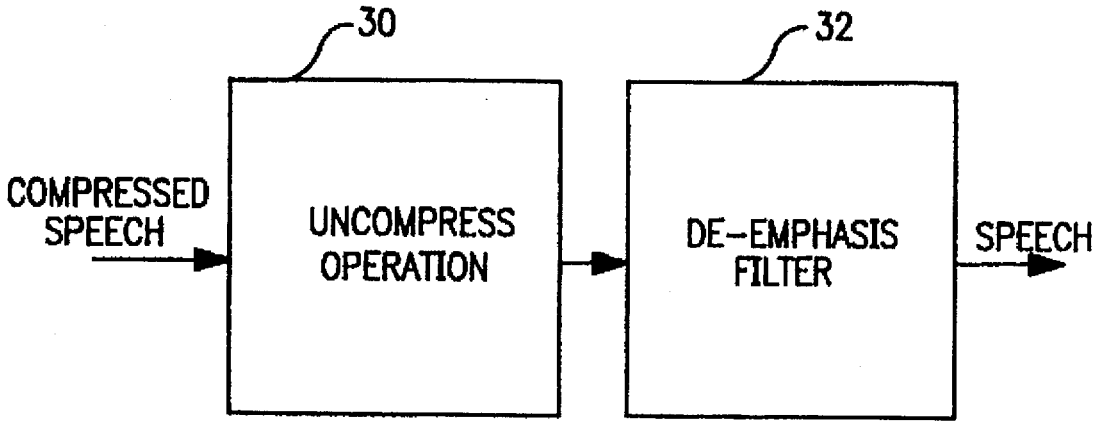
FIG. 4 is a functional block diagram of one embodiment of a circuit for reversing the compression of the speech waveform.

The processed waveform of FIG. 3C is then applied to a de-emphasis filter 32 where the effects of pre-emphasis are removed.

With reference to the compressed waveform illustrated in FIG. 3C, it may be seen that the output waveform has two quarter periods in which the amplitude has been reduced to zero in the circuit 24 of FIG. 1. Note that for this example, the speech waveform was segmented into 16 ms or 128 sample frames. Thus it does not illustrate the use of pitch information in the segmentation procedure and represents the least computationally intensive approach.

From the foregoing, it will be apparent that the system and method of the present invention provide significant advantages over the known prior art. For example, the use of a neural net to perform the calculations of the magnitude to phase transforms dramatically increases the speed of operation, permitting the circuit to operate in real-time. In addition, this invention will allow recoded waveforms to be calculated with less perceived distortion than a heuristically driven Mozer Coder.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A method of compressing speech comprising the steps of:

(a) equalizing the spectral magnitudes of a raw speech waveform;

(b) segmenting the equalized raw speech into initial analysis frames;

(c) detecting the pitch of the raw speech in each segment;

(d) associating the detected pitch with each frame segment;

(e) determining the spectral magnitudes of each frame segment by a Discrete Fourier Transform or FFT at a plurality of points;

(f) normalizing the output signal from the FFT;

(g) applying the normalized FFT signal to a neural net magnitude to phase transform calculator to provide a recoded phase vector.

(h) calculating a new recoded speech waveform by use of an Inverse Discrete Fourier Transform and the un-normalized spectral magnitudes determined in the FFT;

(i) zeroing two quarters with minimum power to produce a compressed speech output signal; and (j) selecting one of the two remaining quarters to characterize the entire frame.

2. The method of claim 1 wherein the selected quarter is the one with the greatest power.

3. The method of claim 1 where the detected pitch is an average of the pitch over plural frames.

4. The method of claim 1 where pitch is continuously detected.

5. The method of claim 1 where the equalizing is accomplished by the steps of:

(k) passing the raw speech through a 1 KHz high pass, RC filter; and (l) digitizing the high pass filtered speech.

6. The method of claim 1 where the equalizing is accomplished in a single zero digital FIR filter.

7. The method of claim 1 wherein the ratio of segment width to the pitch period of raw speech is selectively varied.

8. The method of claim 1 wherein the segments are one pitch period wide.

9. The method of claim 8 including the further step of preserving only one detected pitch period for N segments.

10. A method of compressing speech comprising the steps of:

(a) equalizing the spectral magnitudes of a raw speech waveform;

(b) segmenting the equalized raw speech into initial analysis frames;

(c) detecting the pitch of the raw speech in each segment;

(d) associating the detected pitch with each frame segment;

(e) determining the spectral magnitudes of each frame segment by a Discrete Fourier Transform or FFT at a plurality of points;

(f) normalizing the output signal from the FFT;

(g) applying the normalized FFT signal to a neural net magnitude to phase transform calculator to provide a recoded phase vector.

(h) calculating a new recoded speech waveform by use of an Inverse Discrete Fourier Transform and the normalized spectral magnitudes with a gain constant associated with each segment;

(i) zeroing two quarters with minimum power to produce a compressed speech output signal; and (j) selecting one of the two remaining quarters to characterize the entire frame.

11. A method of increasing the speed of compressing speech comprising the steps of:

(a) equalizing the spectral magnitudes of a raw speech waveform;

(b) segmenting the equalized raw speech into initial analysis frames;

(c) determining the spectral magnitudes of each frame segment by a Discrete Fourier Transform or FFT at a plurality points assuming a constant segment length;

(d) normalizing the output signal from the FFT;

(e) applying the normalized FFT signal to a neural net magnitude to phase transform calculator to provide a recoded phase vector.

(f) calculating a new recoded speech waveform by use of an Inverse Discrete Fourier Transform and the un-normalized spectral magnitudes determined in the FFT;

(g) zeroing two quarters with minimum power to produce a compressed speech output signal; and (h) selecting one of the two remaining quarters to characterize the entire frame.

12. A method of compressing speech comprising the steps of:

(a) filtering raw speech to equalize the spectral amplitudes to remove any spectral tilt;

(b) determining the pitch of the filtered speech (assume a constant if the speech is unvoiced)

(c) segmenting the filtered speech into frames having a length proportional to the detected pitch period;

(d) determining the spectral magnitudes of each segment by a FFT;

(e) calculating the magnitude to phase transform with a neural network to produce the recoded phase vector;

(f) processing the calculated magnitude to phase vector with the spectral magnitudes of the raw speech with an Inverse Discrete Fourier Transform to provide a recoded symmetric waveform; and (g) zeroing the first and fourth quarter waveforms.

13. The method of claim 12 including the further step of recording only one of the second and third quarters to characterize the entire frame with a 4:1 compression ratio.

14. The method of claim 13 including the additional step of compressing the waveform.

15. The method of claim 14 wherein the compression is by differential pulse code modulation.

16. In a method of compressing speech in the time domain waveform for time periods less than about 20 ms by the manipulation of phase parameters, the improvement comprising the step of using an artificial neural network trained to closely approximate the magnitude to phase vector transform in the conversion of spectral magnitudes within an analysis frame to a phase vector.

* * * * *